US008659446B2

(12) United States Patent
Runiks et al.

(10) Patent No.: US 8,659,446 B2
(45) Date of Patent: Feb. 25, 2014

(54) RED ALERT SYSTEM

(76) Inventors: Janis Runiks, Las Vegas, NV (US); John Zonkoski, La Habra, CA (US)

( * ) Notice: Subject to any disclaimer, the term of this patent is extended or adjusted under 35 U.S.C. 154(b) by 286 days.

(21) Appl. No.: 13/247,766

(22) Filed: Sep. 28, 2011

(65) Prior Publication Data

US 2013/0076539 A1 Mar. 28, 2013

(51) Int. Cl.
*G08G 1/01* (2006.01)

(52) U.S. Cl.
USPC ..... 340/933

(58) Field of Classification Search
USPC ..... 340/933, 907, 915, 917; 701/1, 117
See application file for complete search history.

(56) References Cited

U.S. PATENT DOCUMENTS 6,985,073 B1 * 1/2006 Doan ..... 340/425.5
2004/0051651 A1 * 3/2004 Carter ..... 340/907
2004/0252193 A1 * 12/2004 Higgins ..... 348/149
2007/0013552 A1 * 1/2007 Povey et al. ..... 340/907
2012/0287278 A1 * 11/2012 Danis ..... 348/148

* cited by examiner

*Primary Examiner* — Phung Nguyen
(74) *Attorney, Agent, or Firm* — Charles C. H. Wu; Charles C.H. Wu & Assoc., APC

(57) ABSTRACT

Embodiments of a system and method are described. These embodiments may be designed to provide alert to a law enforcement officer monitoring a signalized roadway intersection. In particular, the embodiments comprise a transmitting unit installed in an intersection control cabinet and a radio frequency (RF) remote receiving unit. The transmitting unit comprises at least one cable harness, an on board power supply, a switching circuit, a first central processing unit, and a radio frequency (RF) transmitter. The RF remote receiving unit comprises an internal antenna, a second central processing unit, a battery pack, a power jack and a receiver switch. The RF remote receiving unit alerts the law enforcement officer on the at least one traffic signal information corresponding to red-light-running in a signalized roadway intersection. The at least one traffic signal information is imparted to the law enforcement officer utilizing at least one signal indicator.

18 Claims, 5 Drawing Sheets

RED ALERT SYSTEM

BACKGROUND OF THE INVENTION

1. Technical Field of the Invention

The present embodiment relates in general to systems and methods for providing alerts to law enforcement officers in roadway intersections. More specifically, the present embodiment relates to a system and method for reducing the red light violations and/or collisions in a signalized roadway intersection.

2. Description of the Related Art

A wide variety of alert systems have been developed in the art for preventing and reducing traffic accidents and violations caused due to red-light running. The traffic intersections are signaled to reduce dangerous collisions and accidents. However, the traffic signals can increase the accidents caused due to red-light-running by drivers trying to beat the traffic signals. Law enforcement officers often find it difficult to manage the violations caused by red light runners. The existing traffic alert systems do not provide any method for public safety officials to prevent red-light violations and the accidents caused by these violations.

Many red light violation prevention systems are developed with the intent to provide a warning to vehicle drivers so as to avoid accidents caused due to red light violations. Some of these systems make use of a self-contained operational entity mounted on a traffic signal-light arrangement which includes a visual warning, an audible warning, a radio transceiver, and a system operation controller to provide a method of preventing red light violations by motor vehicle operators due to inattention. If the operator does not slow and/or stop as vehicle approaches a red light, the audible/visual warnings can be used to gain the vehicle operator's attention to slow/stop thereby avoiding motor vehicle collisions within the intersection. This method provides early warning to vehicle operators to avoid vehicle collisions caused by inattention at signaled intersections so equipped. However, the system does not provide red-light violation alerts to the law enforcement officers.

Conventional systems for preventing red-light violations have considerable drawbacks. For example, an existing system includes a traffic light controlling system for transmitting traffic information, a brake system for decelerating or stopping a vehicle under a predetermined control, and a traffic signal violation prevention device installed on the vehicle for receiving the traffic information and transmitting a stop signal to the brake system. The system helps to prevent the user's traffic signal violation using infra-red communication. However, the system requires additional hardware to be installed in the vehicle which provides an inconvenience and additional cost to the user.

In addition, some other existing systems make use of a sensor to detect the status of objects within the traffic environment including the location and speed of vehicles. A computer may be used to determine whether the vehicles are adhering to the traffic laws or other safety concerns. Alarms may accompany the system output to inform the operator what must be done to prevent a collision. Additional sensors and cameras document the identity of violating vehicles as well as any resulting collisions and report the information to predetermined authorities through a multiple-channel communications interface. These systems integrate and synchronize with existing traffic control devices and systems to ensure that it reinforces the traffic laws and the safety intent of the environment in which it is installed. However, this system does not keep the law enforcement officers in the presence of the motor drivers.

Hence, it can be seen, that there is a need for a system that would provide a red light alert to the law enforcement officers in a signaled roadway intersection. Such a system would allow law enforcement officers to assist in preventing violations caused due to red-light runners. This needed system would provide a user-friendly, cost-effective means to reduce the number of red-light-running violations.

SUMMARY OF THE INVENTION

To minimize the limitations found in the prior art, and to minimize other limitations that will be apparent upon the reading of the specifications, preferred embodiment of the present invention provides an automated traffic enforcement system for providing alert to a law enforcement officer in a signalized roadway intersection. The system comprises a transmitting unit installed in an intersection control cabinet and a radio frequency (RF) remote receiving unit designed to impart at least one traffic signal information to the law enforcement officer. The transmitting unit comprises at least one cable harness connected to a power supply voltage terminal, an on board power supply adaptable to drive the transmitting unit and connected to the power supply voltage terminal, a switching circuit connected to eight phase drive signals, a first central processing unit (CPU) to convert the secondary voltage level to a digital code, a radio frequency (RF) transmitter adaptable to transmit the digital code to an external antenna and a transmitter switch configured to operatively select at least one signal frequency. The digital code is configured to include the at least one traffic signal information. The RF remote receiving unit comprises an internal antenna adaptable to receive the digital code transmitted by the external antenna of the transmitting unit, a second central processing unit (CPU) assembled to receive the digital code from the internal antenna, a battery pack operative to power the remote receiving unit, a power jack operative to recharge the remote receiving unit utilizing an external power adaptor and a receiver switch adaptable to match the at least one signal frequency selected by the transmitter switch. The RF remote receiving unit alerts the law enforcement officer on the at least one traffic signal information corresponding to red-light-running in a signalized roadway intersection. The at least one traffic signal information is imparted to the law enforcement officer utilizing one of the three ways such as visually, audibly or tactilely by means of the at least one signal indicator.

Another embodiment provides a method for reducing traffic violations in a signalized roadway intersection utilizing an automated traffic enforcement system.

One objective of the invention is to provide a system that helps to reduce the number of red-light-running violations.

Another objective of the invention is to provide a cost-effective means of automated traffic enforcement.

A third objective of the invention is to provide a system that is user-friendly.

Yet another objective of the invention is to provide a system that allows for the safety of law enforcement officers assisting with traffic law enforcement.

These and other advantages and features of the present invention are described with specificity so as to make the present invention understandable to one of ordinary skill in the art.

BRIEF DESCRIPTION OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention, thus the drawings are generalized in form in the interest of clarity and conciseness.

DETAILED DESCRIPTION OF THE DRAWINGS

In the following discussion that addresses a number of embodiments and applications of the present invention, reference is made to the accompanying drawings that form a part hereof, and in which is shown by way of illustration specific embodiments in which the invention may be practiced. It is to be understood that other embodiments may be utilized and changes may be made without departing from the scope of the present invention.

Various inventive features are described below that can each be used independently of one another or in combination with other features. However, any single inventive feature may not address any of the problems discussed above or only address one of the problems discussed above. Further, one or more of the problems discussed above may not be fully addressed by any of the features described below.

Figure 1:
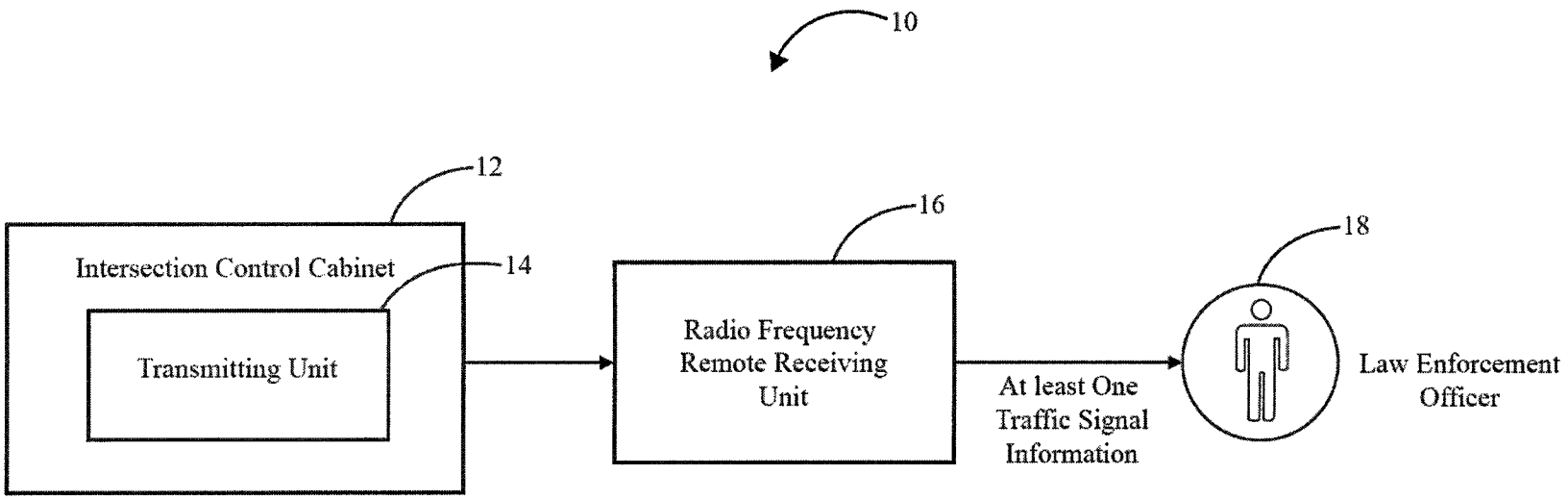
FIG. 1 is a schematic diagram of an automated traffic enforcement system for providing alert to a law enforcement officer in a signalized roadway intersection.

FIG. 1 is a schematic diagram of an automated traffic enforcement system 10 for providing alert to a law enforcement officer 18 in a signalized roadway intersection. The system comprises a transmitting unit 14 installed in an intersection control cabinet 12 and a radio frequency (RF) remote receiving unit 16 designed to impart at least one traffic signal information to the law enforcement officer 18. The RF remote receiving unit 16 alerts the law enforcement officer 18 on the at least one traffic signal information corresponding to red-light-running in a signalized roadway intersection.

Figure 2:
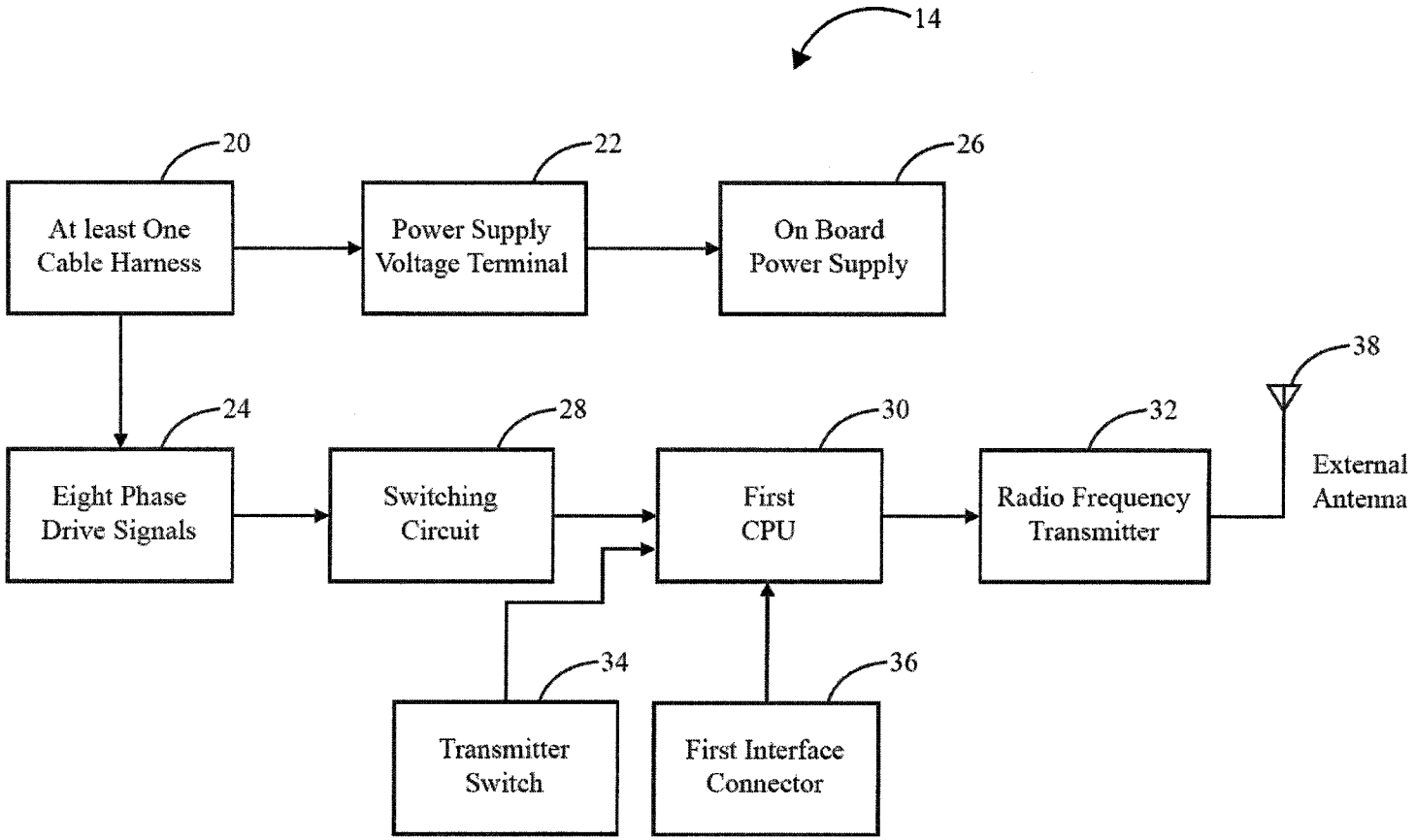
FIG. 2 is a schematic diagram of a transmitting unit of the automated traffic enforcement system.

FIG. 2 is a schematic diagram of the transmitting unit 14 of the automated traffic enforcement system 10. The transmitting unit 14 comprises at least one cable harness 20 connected to a power supply voltage terminal 22 which supplies voltage to an on board power supply 26, a switching circuit 28 connected to eight phase drive signals 24, a first central processing unit (CPU) 30, a RF transmitter 32 adaptable to and a transmitter switch 34 configured to operatively select at least one signal frequency to prevent cross-talk between two signalized roadway intersections. The at least one cable harness 20 is attached to eight phase drive signals 24 which is preset at a primary voltage level. The switching circuit 28 is configured to convert the primary voltage level of the eight phase drive signals 24 to a secondary voltage level. The first CPU 30 utilizes a first software means installed thereon to convert the secondary voltage level to a digital code via a first interface connector 36. The at least one traffic signal information is included in the digital code which is transmitted to an external antenna 38 by the RF transmitter 32.

Figure 3:
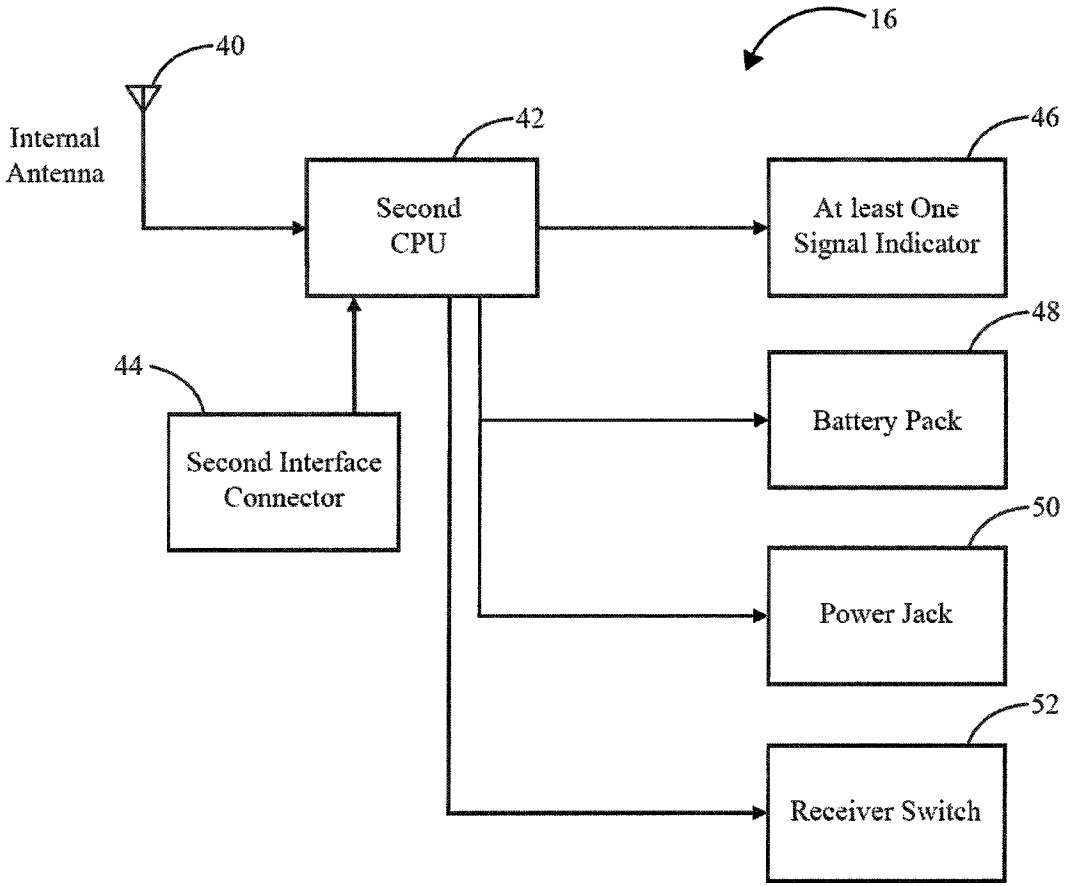
FIG. 3 is a schematic diagram of a radio frequency (RF) remote receiving unit of the automated traffic enforcement system.

FIG. 3 is a schematic diagram of the radio frequency (RF) remote receiving unit 16 of the automated traffic enforcement system 10. The RF remote receiving unit 16 comprises an internal antenna 40 adaptable to receive the digital code transmitted by the external antenna 38 of the transmitting unit 14, a second CPU 42 assembled to receive the digital code from the internal antenna 40, a battery pack 48 operative to power the RF remote receiving unit 16, a power jack 50 operative to recharge the RF remote receiving unit 16 utilizing an external power adaptor (not shown) and a receiver switch 52 adaptable to match the at least one signal frequency selected by the transmitter switch 34. The second CPU 42 is configured to decode the digital code utilizing a second software means installed thereon via a second interface connector 44. The second software means is compatible with the first software means. The second CPU 42 is also configured to send the at least one traffic signal information to at least one signal indicator 46 through a plurality of signal drivers. The battery pack 48 is configured to indicate power level through a light emitting diode (LED) indicator (not shown) attached thereon. The RF remote receiving unit 16 is arranged as a portable unit so that it can be easily carried by the law enforcement officer 18.

The eight phase drive signals 24 are used to drive amber and red lights. The at least one traffic signal information may include display information of amber light and red light in a traffic signal. The at least one traffic signal information is imparted to the law enforcement officer 18 either visually, audibly or tactilely by means of the at least one signal indicator 46. The at least one signal indicator 46 may be selected from a group consisting of a visual display section, an on board speaker, a head phone jack and a buzzer. The visual display section includes a plurality of amber LEDs and a red LED to indicate the at least one traffic signal information. The plurality of amber LEDs may be four in number. The on board speaker and the head phone jack are designed to generate a plurality of tones to alert the law enforcement officer about the display of amber light and red light in the traffic signal. On every amber and red light signals, a corresponding tone is sent to the on board speaker and the head phone jack to alert the law enforcement officer 18 with two different tones. The buzzer is designed to provide tactile alert to the law enforcement officer 18 about the display of red light in the traffic signal. On every red light, the buzzer is activated for a specific period of time. The power supply voltage terminal 22 may be at a voltage level of 24V A/C and the primary voltage level may be at a voltage level of 110 V A/C. The first CPU 30 and the second CPU 42 may be microcontrollers.

Figure 4A:
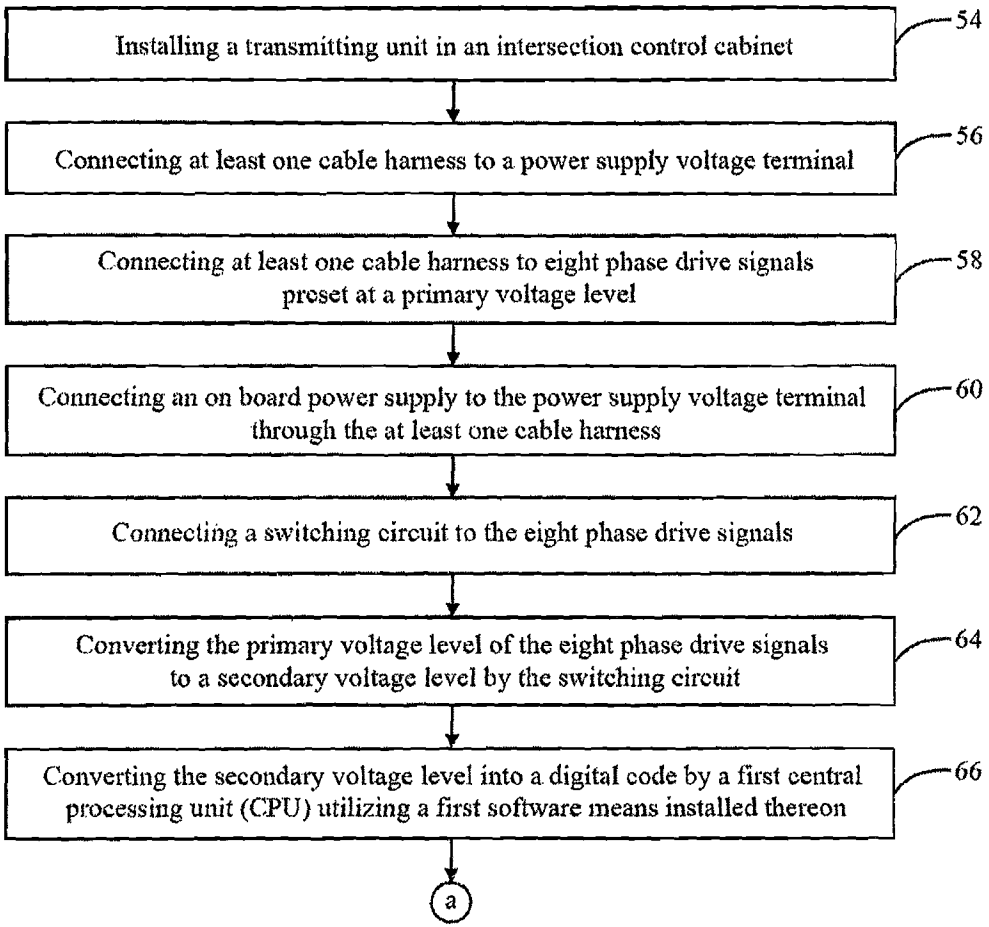
FIG. 4 is a detailed operational flow chart of a method for reducing traffic violations in a signalized roadway intersection utilizing the automated traffic enforcement system.
Figure 4B:
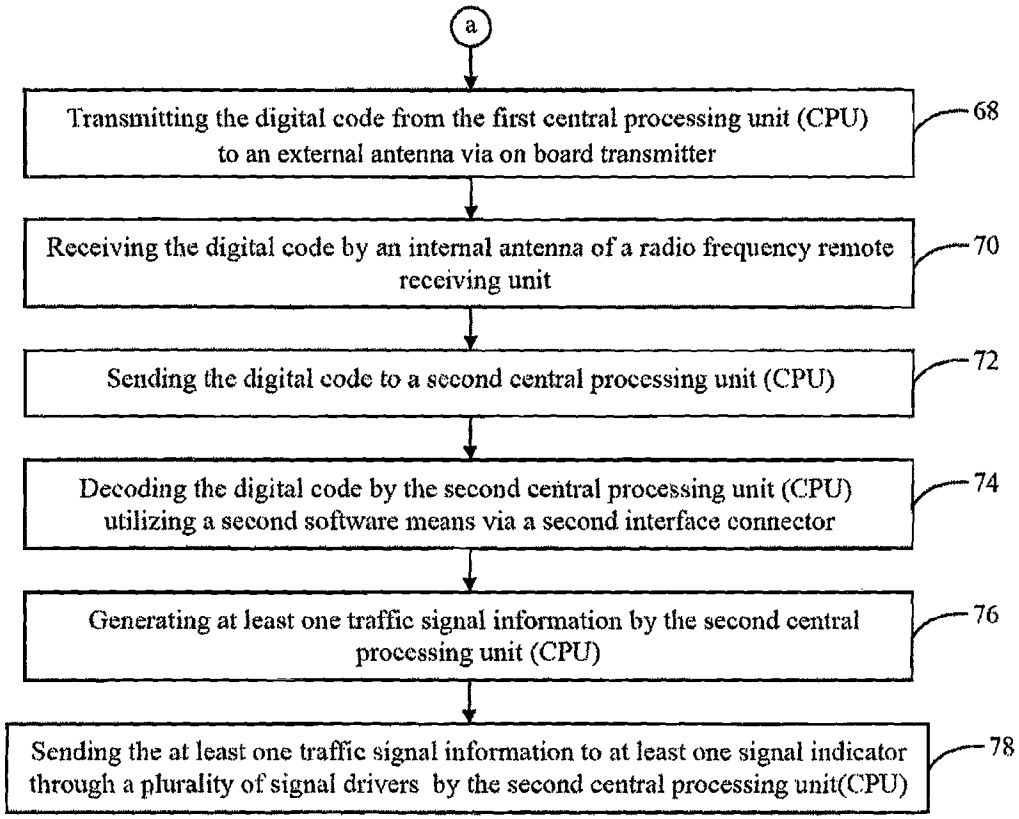

FIG. 4 is an operational flow chart of a method for reducing traffic violations in a signalized roadway intersection utilizing the automated traffic enforcement system. A transmitting unit is installed in an intersection control cabinet as shown in block 54. At least one cable harness is connected to a power supply voltage terminal as indicated at block 56. At least one cable harness is also connected to an eight phase drive signals preset at a primary voltage level as shown in block 58. An on board power supply is connected to the power supply voltage terminal through the at least one cable harness as indicated at block 60. A switching circuit is connected to the eight phase drive signals as shown in block 62. The primary voltage level of the eight phase drive signals is then converted to a secondary voltage level by the switching circuit as indicated at block 64. The secondary voltage level is further converted into a digital code by a first CPU utilizing a first software means installed thereon as indicated at block 66. The digital code from the first CPU is transmitted to an external antenna as shown in block 68. The digital code is then received by an internal antenna of a radio frequency remote receiving unit as indicated at block 70. The digital code is sent to a second CPU as shown in block 72. The digital code is then decoded by the second CPU utilizing a second software means via a second interface connector as indicated at block 74. At least one traffic signal information is then generated by the second CPU as shown in block 76. Finally, the at least one traffic signal information is sent to at least one signal indicator through a plurality of signal drivers by the second CPU as indicated at block 78.

The foregoing description of the preferred embodiment of the present invention has been presented for the purpose of illustration and description. It is not intended to be exhaustive or to limit the invention to the precise form disclosed. Many modifications and variations are possible in light of the above teachings. For example, the transmitting unit 14 may be moved to other signalized intersections by employing additional cable assemblies. It is intended that the scope of the present invention not be limited by this detailed description, but by the claims and the equivalents to the claims appended hereto.

What is claimed is:

1. An automated traffic enforcement system for providing alert to a law enforcement officer in a signalized roadway intersection, the system comprising:

a transmitting unit installed in an intersection control cabinet, the transmitting unit comprising:

at least one cable harness connected to a power supply voltage terminal, the at least one cable harness attached to eight phase drive signals, the eight phase drive signals being preset at a primary voltage level;

an on board power supply adaptable to drive the transmitting unit, the on board power supply being connected to the power supply voltage terminal;

a switching circuit connected to the eight phase drive signals, the switching circuit being configured to convert the primary voltage level of the eight phase drive signals to a secondary voltage level;

a first central processing unit (CPU) to convert the secondary voltage level to a digital code utilizing a first software means installed thereon via a first interface connector, the digital code configured to include at least one traffic signal information;

a radio frequency (RF) transmitter adaptable to transmit the digital code to an external antenna; and a transmitter switch configured to operatively select at least one signal frequency; and a radio frequency (RF) remote receiving unit designed to impart the at least one traffic signal information to the law enforcement officer, the RF remote receiving unit comprising:

an internal antenna adaptable to receive the digital code transmitted by the external antenna;

a second central processing unit (CPU) assembled to receive the digital code from the internal antenna, the second CPU configured to decode the digital code utilizing a second software means installed thereon via a second interface connector, the second CPU configured to send the at least one traffic signal information to at least one signal indicator through a plurality of signal drivers;

a battery pack operative to power the RF remote receiving unit, the battery pack being configured to indicate power level through a light emitting diode (LED) indicator attached thereon;

a power jack operative to recharge the RF remote receiving unit utilizing an external power adaptor; and a receiver switch adaptable to match the at least one signal frequency selected by the transmitter switch;

whereby the RF remote receiving unit alerts the law enforcement officer on the at least one traffic signal information corresponding to red-light-running in a signalized roadway intersection.

2. The system of claim 1 wherein the eight phase drive signals are used to drive amber and red lights.

3. The system of claim 1 wherein the at least one traffic signal information may include display information of amber light and red light in a traffic signal.

4. The system of claim 1 wherein the at least one signal indicator may be selected from a group consisting of a visual display section, an on board speaker, a head phone jack and a buzzer.

5. The system of claim 4 wherein the visual display section includes a plurality of amber LEDs and a red LED to indicate the at least one traffic signal information.

6. The system of claim 4 wherein the on board speaker and the head phone jack are designed to generate a plurality of tones to alert the law enforcement officer about the display of amber light and red light in the traffic signal.

7. The system of claim 4 wherein the buzzer is designed to alert the law enforcement officer about the display of red light in the traffic signal.

8. The system of claim 1 wherein the second software means is compatible with the first software means.

9. The system of claim 1 wherein the transmitter switch is configured to prevent cross-talk between two signalized roadway intersections.

10. The system of claim 1 wherein the power supply voltage terminal may be at a voltage level of 24V A/C.

11. The system of claim 1 wherein the primary voltage level may be at a voltage level of 110 V A/C.

12. The system of claim 1 wherein the RF remote receiving unit is portable.

13. A method for reducing traffic violations in a signalized roadway intersection utilizing an automated traffic enforcement system, the method comprising the steps of:

(a) installing a transmitting unit in an intersection control cabinet;

(b) connecting at least one cable harness to a power supply voltage terminal;

(c) connecting at least one cable harness to an eight phase drive signals, the eight phase drive signals being preset at a primary voltage level;

(d) connecting an on board power supply to the power supply voltage terminal through the at least one cable harness;

(e) connecting a switching circuit to the eight phase drive signals;

(f) converting the primary voltage level of the eight phase drive signals to a secondary voltage level by the switching circuit;

(g) converting the secondary voltage level into a digital code by a first central processing unit (CPU) utilizing a first software means installed thereon;

(h) transmitting the digital code from the first central processing unit (CPU) to an external antenna;

(i) receiving the digital code by an internal antenna of a radio frequency remote receiving unit;

(j) sending the digital code to a second central processing unit (CPU);

(k) decoding the digital code by the second central processing unit (CPU) utilizing a second software means via a second interface connector;

(l) generating at least one traffic signal information by the second central processing unit (CPU); and (m) sending the at least one traffic signal information to at least one signal indicator through a plurality of signal drivers by the second central processing unit (CPU).

14. The method of claim 13 wherein the eight phase drive signals are used to drive amber and red lights.

15. The method of claim 13 wherein the second software means is compatible with the first software means.

16. The method of claim 13 wherein the power supply voltage terminal may be at a voltage level of 24V A/C.

17. The method of claim 13 wherein the primary voltage level may be at a voltage level of 110 V A/C.

18. The method of claim 13 wherein the RF remote receiving unit is portable.

* * * * *